US007639185B2

(12) United States Patent
Mei

(10) Patent No.: US 7,639,185 B2
(45) Date of Patent: Dec. 29, 2009

(54) ANTENNA AND ANTENNA ASSEMBLY THEREOF

(75) Inventor: Chia-Hao Mei, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 262 days.

(21) Appl. No.: 11/616,888

(22) Filed: Dec. 28, 2006

(65) Prior Publication Data

US 2008/0094283 A1 Apr. 24, 2008

(30) Foreign Application Priority Data

Oct. 20, 2006 (CN) ..... 2006 1 0063215

(51) Int. Cl.
*H01Q 1/38* (2006.01)

(52) U.S. Cl. ..... 343/700 MS; 343/846; 343/795

(58) Field of Classification Search ..... 343/700 MS, 343/795, 829, 846, 848, 895
See application file for complete search history.

(56) References Cited

U.S. PATENT DOCUMENTS 6,094,170 A 7/2000 Peng
6,801,168 B1 * 10/2004 Yeh ..... 343/700 MS
7,042,412 B2 * 5/2006 Chuang ..... 343/795
7,268,737 B1 * 9/2007 Ai et al. ..... 343/795
7,274,339 B2 * 9/2007 Wu et al. ..... 343/795
7,385,556 B2 * 6/2008 Chung et al. ..... 343/700 MS
7,405,699 B2 * 7/2008 Qin ..... 343/700 MS

FOREIGN PATENT DOCUMENTS

TW M253918 12/2004
TW M293545 7/2006

* cited by examiner

*Primary Examiner*—Douglas W Owens
*Assistant Examiner*—Chuc D Tran
(74) *Attorney, Agent, or Firm*—Wei Te Chung

(57) ABSTRACT

An antenna disposed on a circuit board includes a first surface, a second surface, a feeding part, a body portion, a first accessory portion, a second accessory portion, and a ground plane. The feeding part includes a first feeding segment disposed on the first surface and a second feeding segment disposed on the second surface. The body portion includes a first radiation part, a second radiation part, a third radiation part, and a fourth radiation part. The first accessory portion, the second accessory portion, the first radiation part, and the second radiation part are all disposed on the first surface. The third radiation part and the fourth radiation part are disposed on the second surface. The ground plane includes a pair of first ground parts disposed on the first surface and a second ground part disposed on the second surface.

17 Claims, 7 Drawing Sheets

ANTENNA AND ANTENNA ASSEMBLY THEREOF

BACKGROUND OF THE INVENTION

1. Field of the Invention

The present invention relates to antennas and antenna assemblies thereof, and particularly to an antenna and an antenna assembly in a wireless local area network (WLAN) device.

2. Description of Related Art

Nowadays, wireless communication devices, such as mobile phone handsets and portable computers, are becoming more and more popular. In order to communicate with one or more base stations, the wireless communication devices usually have to be equipped with an antenna. Many wireless communication devices contain an antenna assembly consisting of a plurality of antennas, in order to achieve multi input multi output (MIMO) wireless communication functions. Greater miniaturization of antennas is sought, to help contribute to further miniaturization of wireless communication devices.

Therefore, a need exists in the industry to overcome the aforementioned deficiencies and inadequacies.

SUMMARY OF THE INVENTION

In one aspect of the invention, an antenna disposed on a circuit board includes a first surface and a second surface opposite to the first surface. The antenna includes a feeding part, a body portion, a first accessory portion, a second accessory portion, and a ground plane. The feeding part for feeding electromagnetic signals, includes a first feeding segment disposed on the first surface and a second feeding segment disposed on the second surface. The body portion for radiating and receiving electromagnetic signals, includes a first radiation part, a second radiation part, a third radiation part, and a fourth radiation part. The first radiation part and the second radiation part are disposed on the first surface, and electronically connected to the first feeding segment. The third radiation part and the fourth radiation part are disposed on the second surface, and electronically connected to the second feeding segment. The first accessory portion is disposed on the first surface, and electronically connected to the first radiation part. The second accessory portion is disposed on the first surface, and electronically connected to the second radiation part. The ground plane for grounding includes a pair of first ground parts disposed on the first surface and a second ground part disposed on the second surface.

In another aspect of the invention, an antenna assembly disposed on a circuit board includes a first surface and a second surface opposite to the first surface. The antenna assembly includes a first antenna, a second antenna, and a third antenna. The first antenna includes a feeding part, a body portion, and a ground plane. The feeding part for feeding electromagnetic signals, includes a first feeding segment disposed on the first surface and a second feeding segment disposed on the second surface. The body portion for radiating and receiving electromagnetic signals, includes a first radiation part, a second radiation part, a third radiation part, and a fourth radiation part. The first radiation part and the second radiation part are disposed on the first surface, and electronically connected to the first feeding segment. The third radiation part and the fourth radiation part are disposed on the second surface, and electronically connected to the second feeding segment. The ground plane is for grounding.

In another aspect of the invention, an antenna assembly disposed on a circuit board includes a first surface and a second surface opposite to the first surface. The antenna assembly includes a plurality of antennas. Each antenna includes a feeding part, a body portion, and a ground plane. The feeding part for feeding electromagnetic signals, includes a first feeding segment disposed on the first surface and a second feeding segment disposed on the second surface. The body portion for radiating and receiving electromagnetic signals, includes a first radiation part, a second radiation part, a third radiation part, and a fourth radiation part. The first radiation part and the second radiation part are disposed on the first surface, and electronically connected to the first feeding segment. The third radiation part and the fourth radiation part are disposed on the second surface, and electronically connected to the second feeding segment. The ground plane is for grounding.

Other advantages and novel features will become more apparent from the following detailed description when taken in conjunction with the accompanying drawings, in which:

BRIEF DESCRIPTION OF THE DRAWINGS

FIG. 2 is operated at 2.4 GHz;

FIG. 2 is operated at 2.5 GHz;

DETAILED DESCRIPTION OF THE INVENTION

Figure 1A:
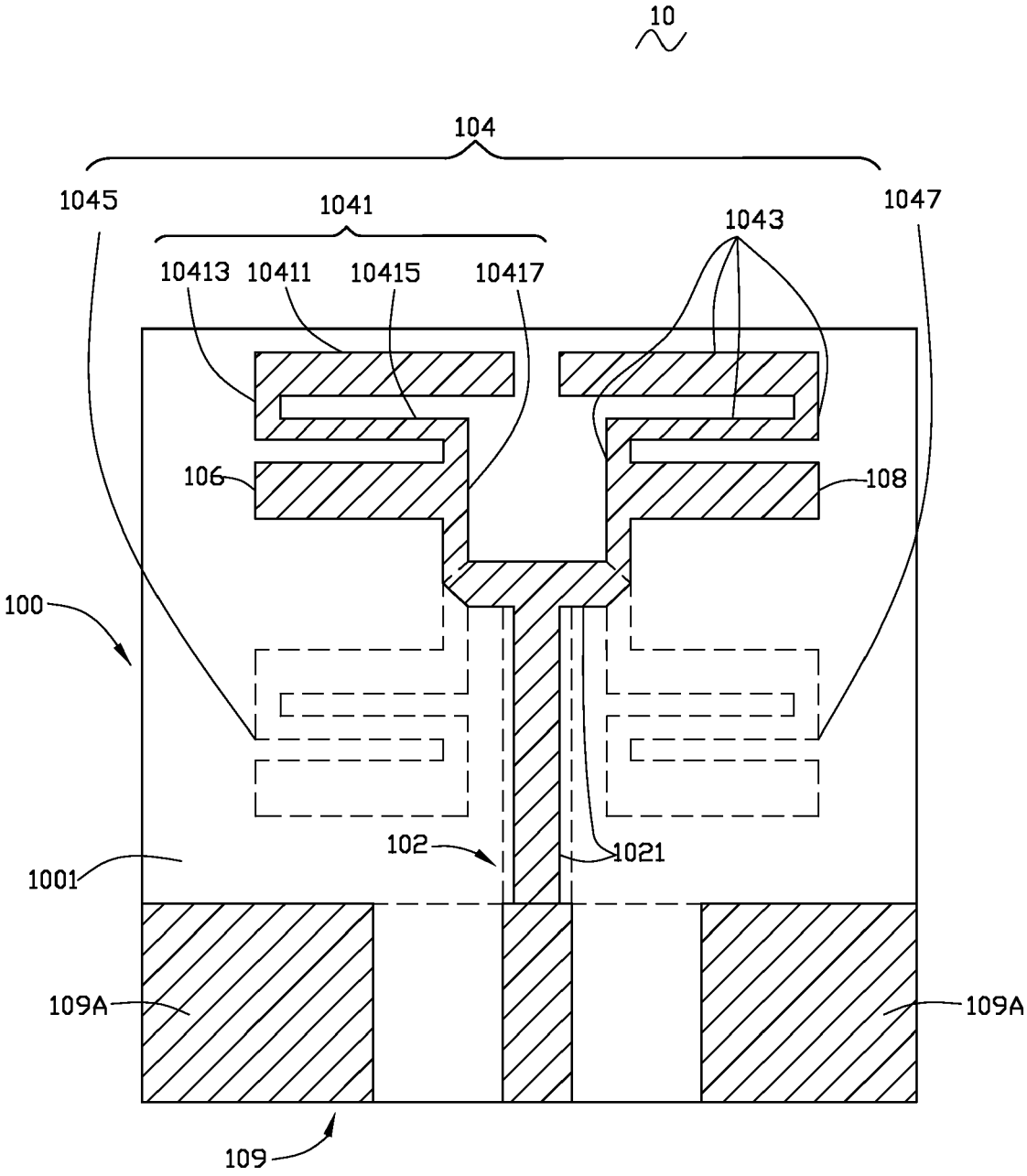
FIG. 1A is a schematic view of an antenna on a first surface of a circuit board of an exemplary embodiment of the present invention.
Figure 1B:
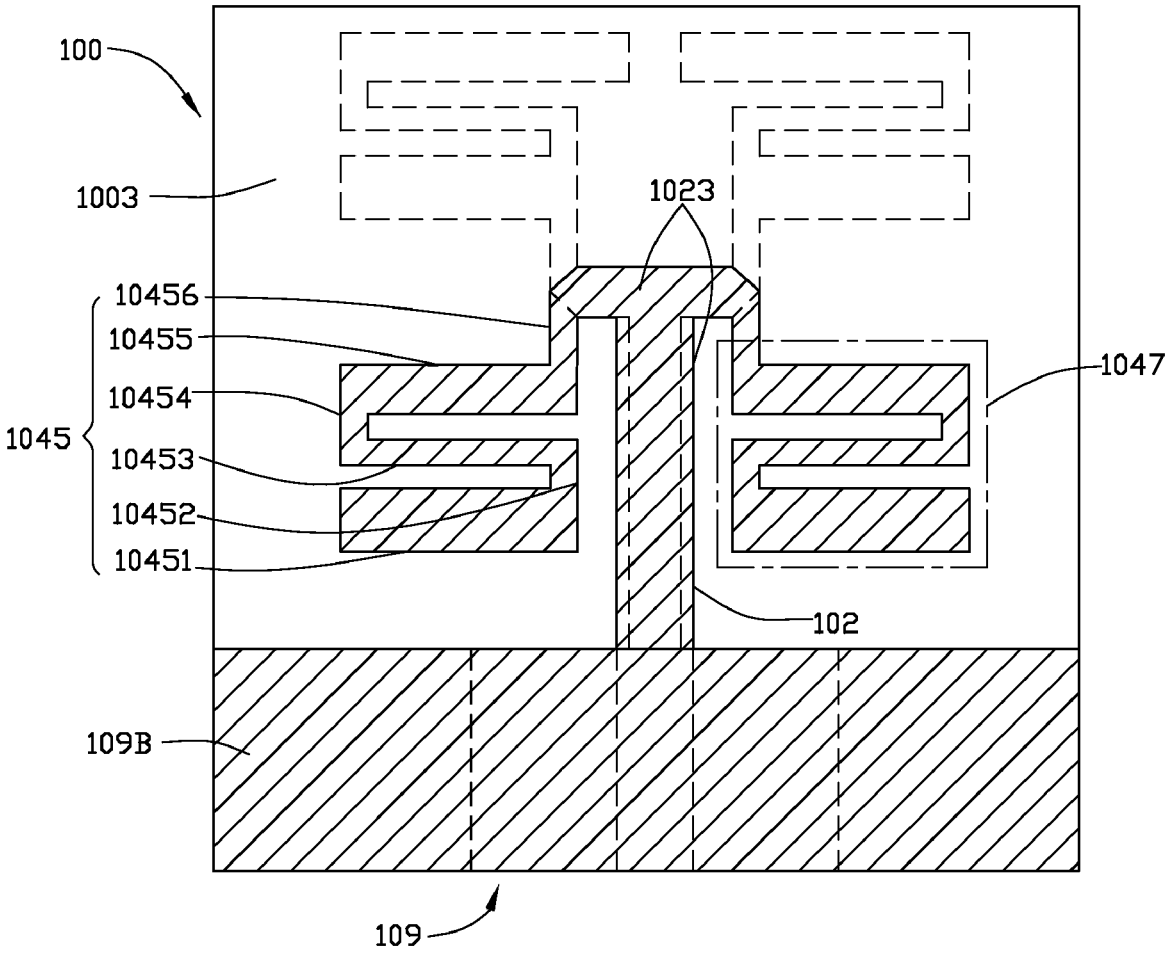
FIG. 1B is a schematic view of the antenna on a second surface of the circuit board of FIG. 1A.

FIG. 1A is a schematic view of an antenna 10 disposed on a first surface 1001 of a circuit board 100, and FIG. 1B is a schematic view of the antenna 10 disposed on a second surface 1003 of the circuit board 100. The first surface 1001 is opposite to the second surface 1003.

The antenna 10 includes a feeding part 102, a body portion 104, a first accessory portion 106, a second accessory portion 108, and a ground plane 109. The feeding part 102 for feeding electromagnetic signals includes a first feeding segment 1021 disposed on the first surface 1001 and a second feeding segment 1023 disposed on the second surface 1003. In the exemplary embodiment, the first feeding segment 1021 and the second feeding segment 1023 are substantially T shaped.

The body portion 104 for radiating and receiving electromagnetic signals includes a first radiation part 1041, a second radiation part 1043, a third radiation part 1045, and a fourth radiation part 1047. The first radiation part 1041 and the second radiation part 1043 are both disposed on the first surface 1001 and have a bent shape. The first radiation part 1041 and the second radiation part 1043 are electronically connected to the first feeding segment 1021, and symmetrically disposed at opposite sides of the first feeding segment 1021. In the exemplary embodiment, the second radiation part 1043 has the same structure and size as the first radiation part 1041.

In the exemplary embodiment, the first radiation part 1041 includes electronically connected radiation segments, which include a first radiation segment 10411 connected to a second radiation segment 10413, which in turn is connected to a third radiation segment 10415, which in turn is connected to a fourth radiation segment 10417. The first radiation segment 10411 is parallel to the third radiation segment 10415, and the second radiation segment 10413 is parallel to the fourth radiation segment 10413. The end-to-end connections of the radiation segments 10411-10417 form a switchback pattern.

In the exemplary embodiment, a length and a width of the first radiation segment 10411 are respectively about 11 mm and 2 mm, a length and a width of the second radiation segment 10413 are respectively about 4 mm and 1 mm, a length and a width of the third radiation segment 10415 are respectively about 9 mm and 1 mm, and a length and a width of the fourth radiation segment 10417 are respectively about 6.5 mm and 1 mm.

The third radiation part 1045 and the fourth radiation part 1047 are both disposed on the second surface 1003 with a bent shape, and are electronically connected to the second feeding segment 1023. In the exemplary embodiment, the fourth radiation part 1047 has the same structure and size as the third radiation part 1045, and the third radiation part 1045 and the fourth radiation part 1047 are symmetrically disposed at the opposite sides of the second feeding segment 1023.

In the exemplary embodiment, the third radiation part 1045 includes electronically connected radiation and connection segments, which include a fifth radiation segment 10451 connected to a first connection segment 10452, which in turn is connected to a sixth radiation segment 10453, which in turn is connected to a second connection segment 10454, which in turn is connected to a seventh radiation segment 10455, which in turn is connected to a third connection segment 10456. The fifth radiation segment 10451 and the sixth radiation segment 10453 are parallel to the seventh radiation segment 10455, and the first connection segment 10452 and the second connection segment 10454 are parallel to the third connection segment 10456. The end-to-end connections of the segments 10451-10456 form a switchback pattern.

In the exemplary embodiment, a length and a width of the fifth radiation segment 10451 are respectively about 9 mm and 2.5 mm, a length and a width of the sixth radiation segment 10453 are respectively about 9 mm and 1 mm, and a length and a width of the seventh radiation segment 10455 are respectively about 9 mm and 2 mm. A length and a width of the first connection segment 10452 are respectively about 1 mm and 1 mm, a length and a width of the second connection segment 10454 are respectively about 1 mm and 1 mm, and a length and a width of the third connection segment 10456 are respectively about 3 mm and 1 mm.

The first accessory portion 106 is disposed on the first surface 1001, and is electronically connected to the first radiation part 1041, for enhancing coupling effect therebetween. In the exemplary embodiment, the first accessory portion 106 is substantially rectangular, and is parallel to the first accessory portion 106.

The second accessory portion 108 is also disposed on the first surface 1001, and is electronically connected to the second radiation part 1043, for enhancing coupling effect therebetween. In the exemplary embodiment, the second accessory portion 108 is substantially rectangular, and the first accessory portion 106 and the second accessory portion 108 are symmetrically disposed at the opposite sides of the first feeding segment 1021.

The ground plane 109 for grounding includes a pair of first ground parts 109A disposed on the first surface 1007 and a second ground part 109B disposed on the second surface 1003. The first ground parts 109A are substantially rectangular, and symmetrically disposed at the opposite sides of the first feeding segment 1021. The second ground part 109B is substantially rectangular, and is electronically connected to the first ground parts 109A. The second ground part 109B is electronically connected to the second feeding segment 1023.

Figure 2:
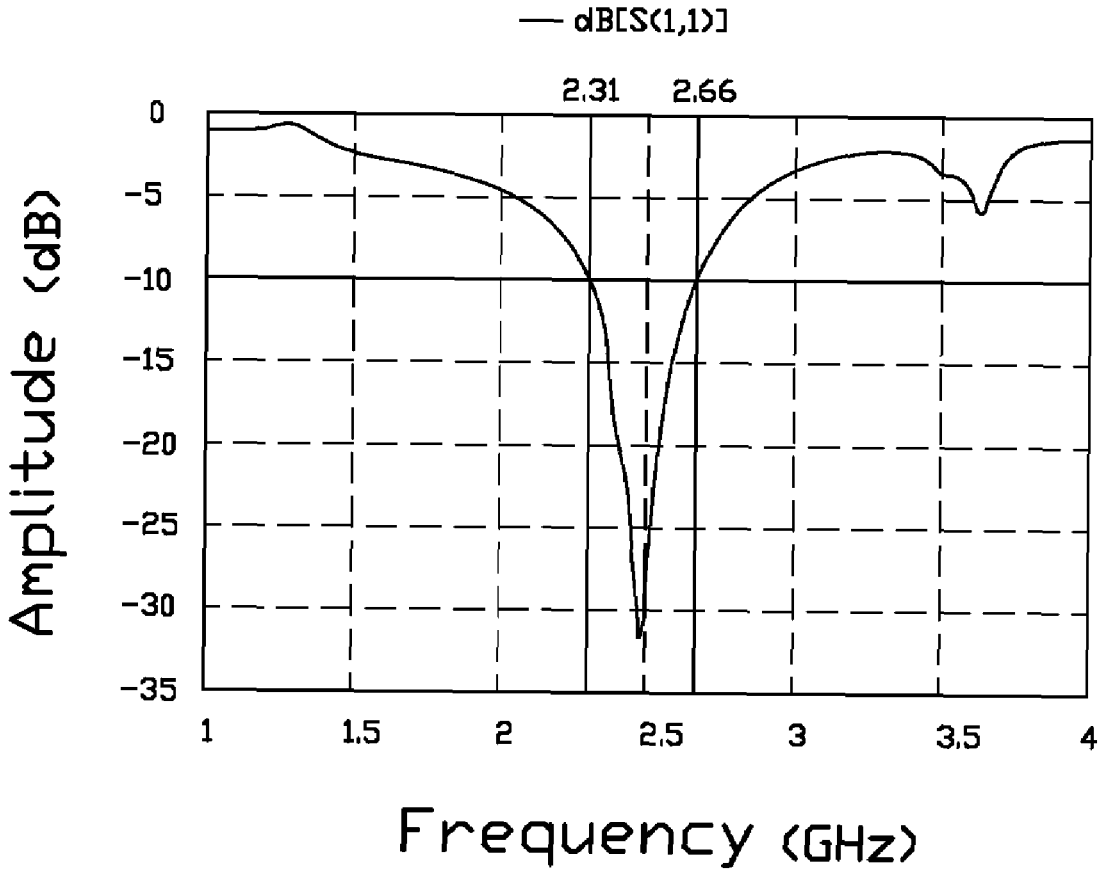
FIG. 2 is a graph of simulated results showing voltage standing wave ratio of the antenna of FIG. 1 and FIG. 2.

Referring to FIG. 2, a graph of simulated results showing voltage standing wave ratio (VSWR) of the antenna 10 is shown. The horizontal axis represents the frequency in gigahertz (GHz) of the antenna 10, and the vertical axis represents VSWR. As shown, when the antenna 10 operates at working frequency bands of 2.31~2.66 GHz, its VSWR is less than 2, which is within operating standards set forth in IEEE 802.11b.

Figure 3:
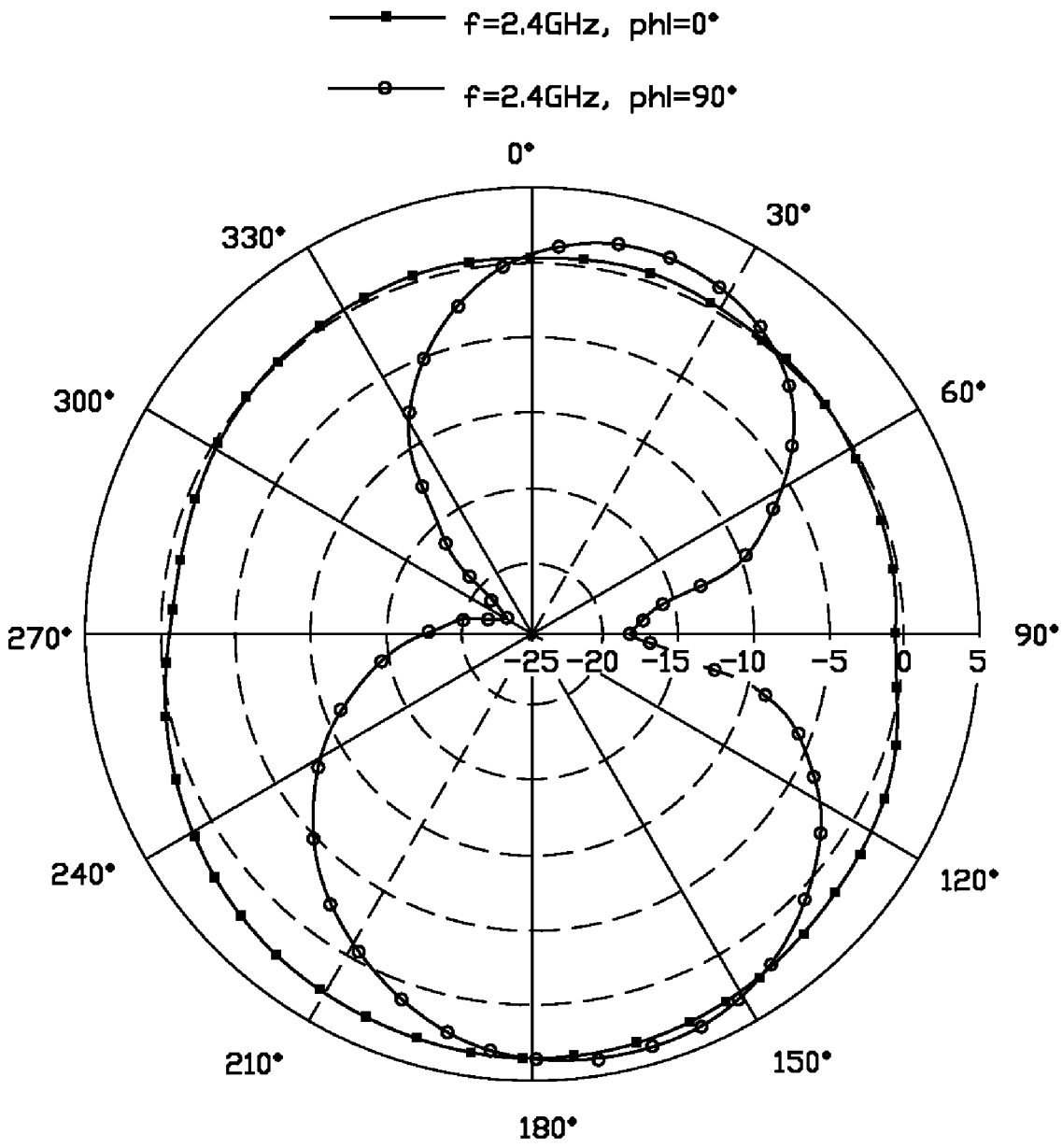
FIG. 3 is a graph of simulated results showing radiation patterns when the antenna of FIG. 1
Figure 4:
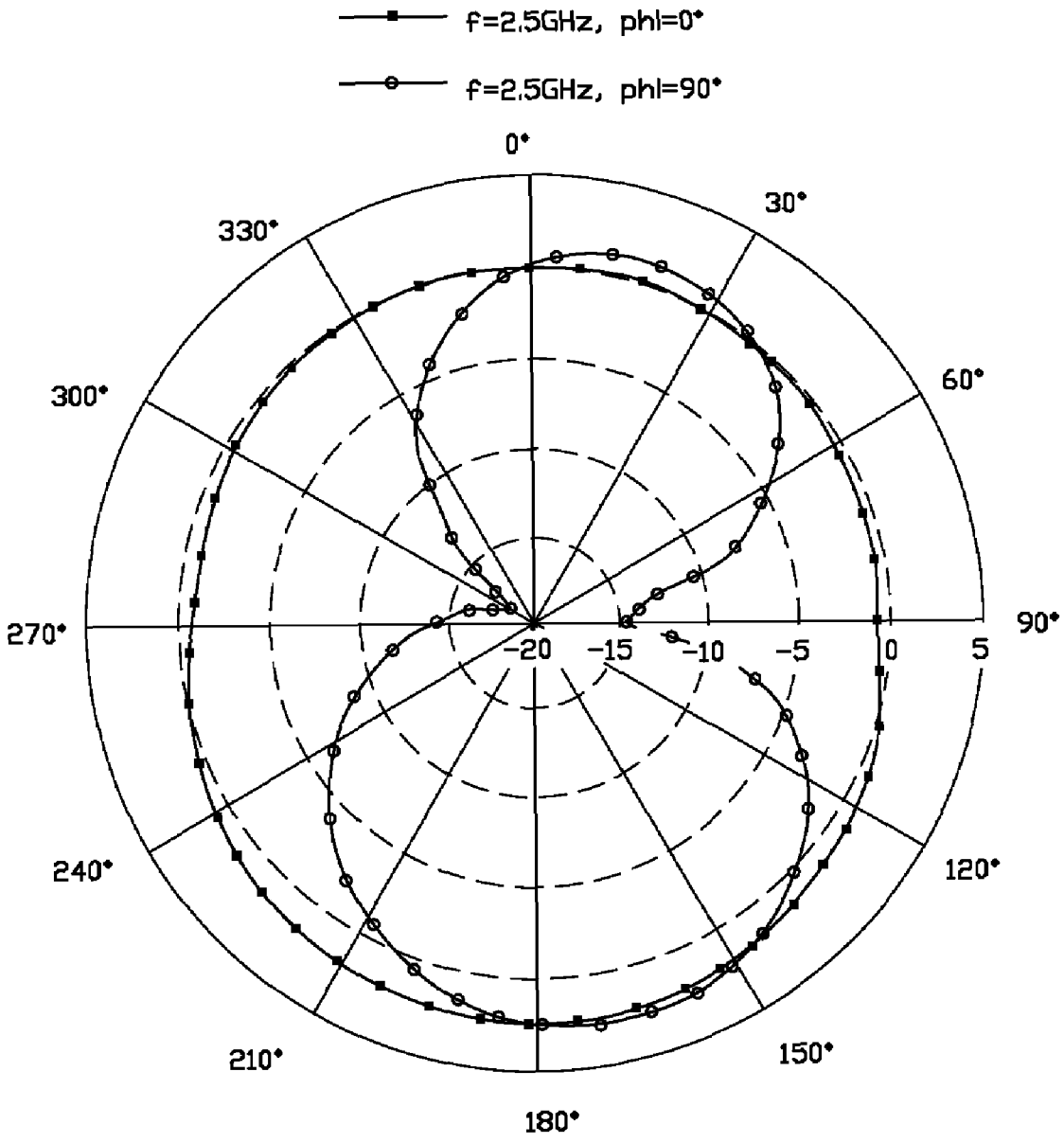
FIG. 4 is a graph of simulated results showing radiation patterns when the antenna of FIG. 1

FIG. 3 and FIG. 4 are graphs of simulated results showing radiation patterns when the antenna 10 is respectively operated at 2.4 GHz and 2.5 GHz. It is to be noted that the antenna 10 has good radiation performance in all directions, and the maximum value of the gain is greater than 1.5 dB.

Figure 5:
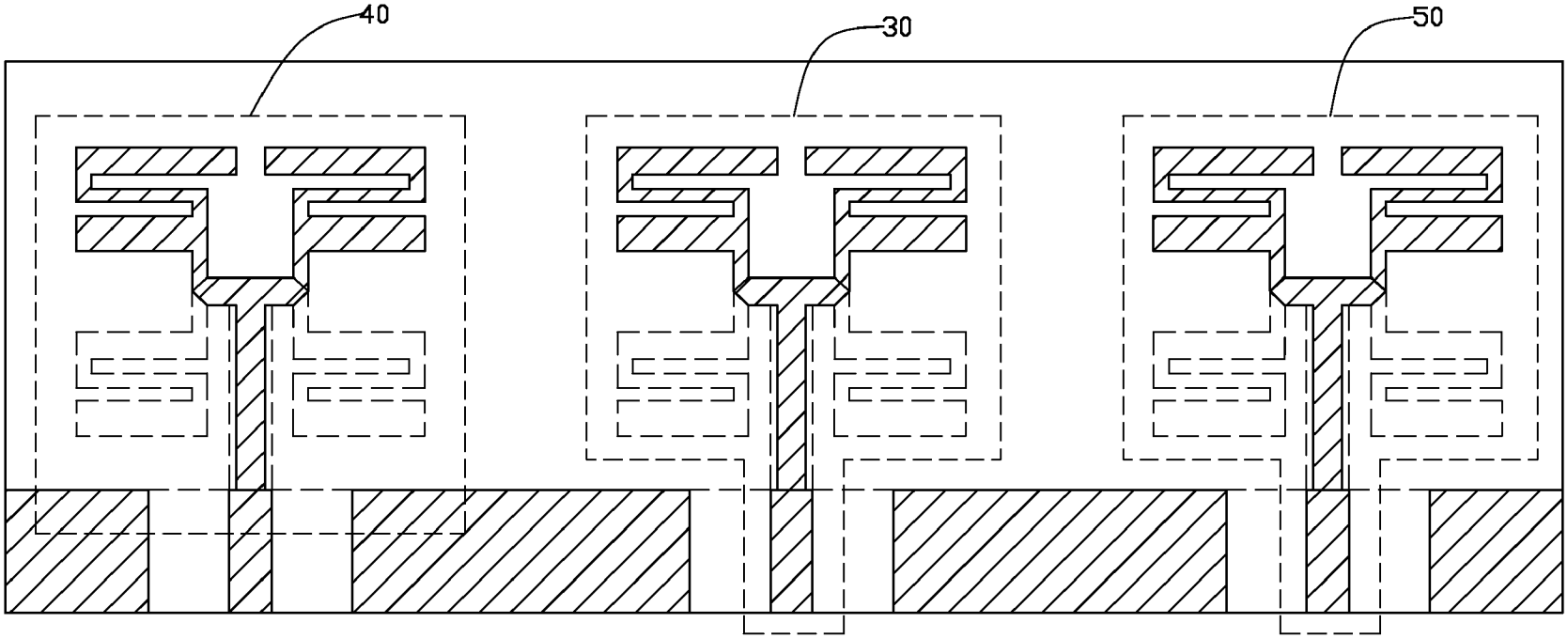
FIG. 5 is a schematic view of an antenna assembly of an exemplary embodiment of the present invention.

FIG. 5 is a schematic view of an antenna assembly 20 of an exemplary embodiment of the present invention. The antenna assembly 20 includes a first antenna 30, a second antenna 40, and a third antenna 50. The first antenna 30, the second antenna 40, and the third antenna 50 respectively have the same structure as the antenna 10 and are disposed in parallel, and thus, descriptions of the structures of the first antenna 30, the second antenna 40, and the third antenna 50 are omitted.

The second antenna 40 and the third antenna 50 are disposed at opposite sides of the first antenna 30. A distance between the first antenna 30 and the second antenna 40 is equal to a distance between the first antenna 30 and the third antenna 50, and the distances are approximately equal to a half working frequency wavelength. Differential phases between the antennas are 0 degrees.

In other exemplary embodiments, the antenna assembly 20 includes a plurality of antennas 10, and the antennas 10 are equidistantly disposed on the circuit board 100.

Figure 6:
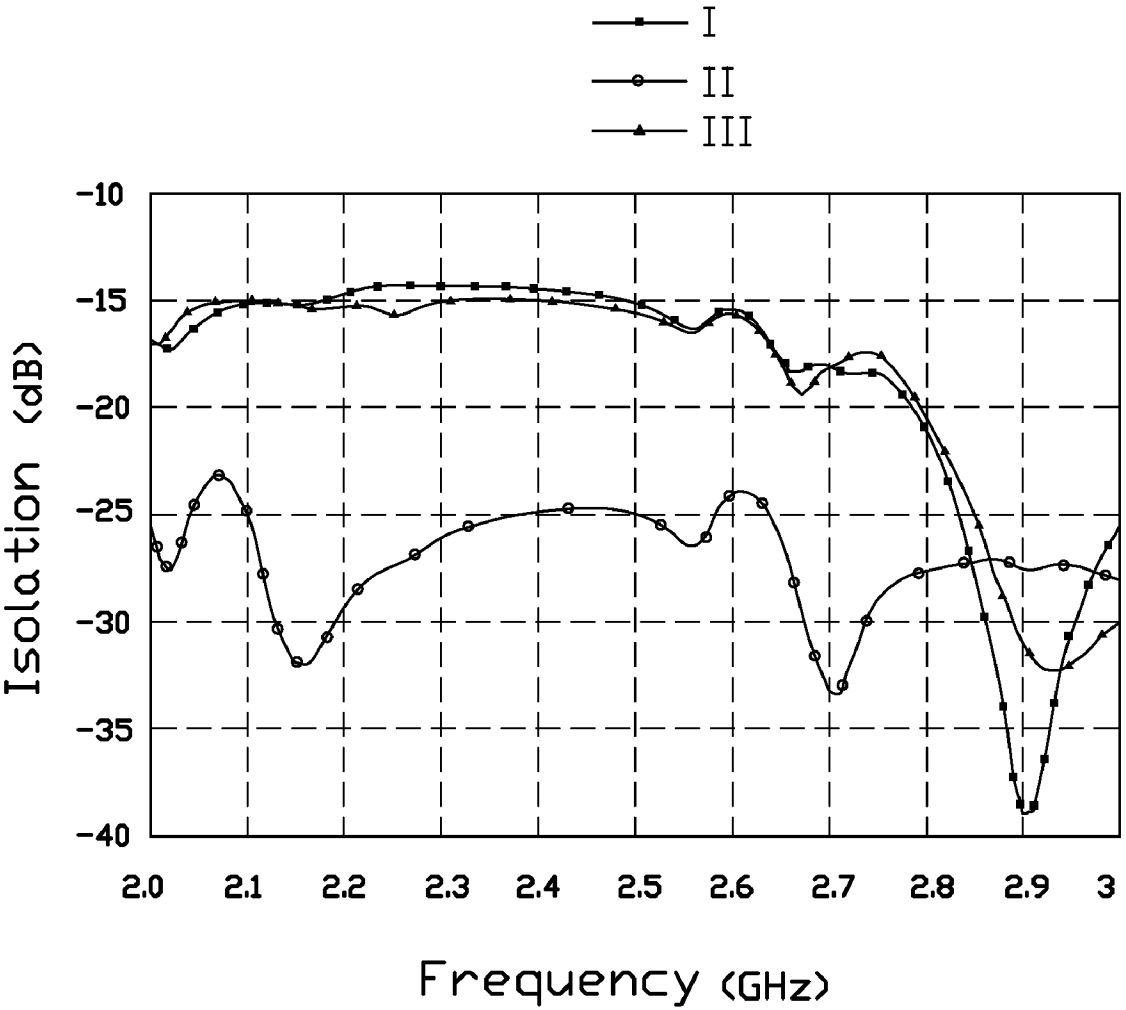
FIG. 6 is a graph of simulated results showing isolation of the antenna assembly of FIG. 5.

FIG. 6 is a graph of simulated results showing isolation of the antenna assembly 20 of FIG. 5. The horizontal axis represents the frequency in gigahertz (GHz) of the antenna assembly 20, and the vertical axis represents isolation. The curve I represents the isolation between the first antenna 30 and the second antenna 40, the curve II represents the isolation between the second antenna 40 and the third antenna 50, and the curve III represents the isolation between the first antenna 30 and the third antenna 50.

As shown in FIG. 6, when the antenna assembly 20 operates at 2.4 GHz, the isolation between the first antenna 30 and the second antenna 40 is about −15 dB, the isolation between the second antenna 40 and the third antenna 50 is about −24.8 dB, and the isolation between the first antenna 30 and the third antenna 50 is about −14.5 dB.

When the antenna assembly 20 operates at 2.5 GHz, the isolation between the first antenna 30 and the second antenna 40 is about −15.6 dB, the isolation between the second antenna 40 and the third antenna 50 is about −24.9 dB, and the isolation between the first antenna 30 and the third antenna 50 is about −15.1 dB. Therefore, an average isolation of the antenna assembly 20 is less than −10 dB, and the antenna assembly 20 suitably meets multi input multi output (MIMO) standards.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. An antenna, disposed on a circuit board comprising a first surface and a second surface opposite to the first surface, the antenna comprising:

a feeding part for feeding electromagnetic signals, comprising a first feeding segment disposed on the first surface and a second feeding segment disposed on the second surface;

a body portion for radiating and receiving electromagnetic signals, comprising a first radiation part, a second radiation part, a third radiation part, and a fourth radiation part, wherein the first radiation part and the second radiation part are disposed on the first surface, and electronically connected to the first feeding segment, the third radiation part and the fourth radiation part are disposed on the second surface, and electronically connected to the second feeding segment;

a first accessory portion disposed on the first surface, and electronically connected to the first radiation part for enhancing coupling effect therebetween;

a second accessory portion disposed on the first surface, and electronically connected to the second radiation part for enhancing coupling effect therebetween; and a ground plane for grounding, comprising a pair of first ground parts disposed on the first surface and a second ground part disposed on the second surface.

2. The antenna of claim 1, wherein the first radiation part and the second radiation part are symmetrically disposed at opposite sides of the first feeding segment with a switchback shape.

3. The antenna of claim 2, wherein the third radiation part and the fourth radiation part are symmetrically disposed at the opposite sides of the second feeding segment with a switchback shape.

4. The antenna of claim 3, wherein the first radiation part comprises:

a first radiation segment;

a second radiation segment electronically connected to the first radiation segment;

a third radiation segment parallel to the first radiation segment, and electronically connected to the second radiation segment; and a fourth radiation segment parallel to the second radiation segment, and electronically connected to the third radiation segment.

5. The antenna assembly of claim 1, wherein the first radiation part, the second radiation part, the third radiation part, and the fourth radiation part have a same structure.

6. The antenna of claim 1, wherein the first ground parts are symmetrically disposed at the opposite sides of the first feeding segment, the second ground part is electronically connected to the first ground parts and the second feeding segment.

7. An antenna assembly, disposed on a circuit board comprising a first surface and a second surface opposite to the first surface, the antenna assembly comprising:

a first antenna comprising:

a feeding part for feeding electromagnetic signals, comprising a first feeding segment disposed on the first surface and a second feeding segment disposed on the second surface;

a body portion for radiating and receiving electromagnetic signals, comprising a first radiation part, a second radiation part, a third radiation part, and a fourth radiation part, wherein the first radiation part and the second radiation part are disposed on the first surface, and electronically connected to the first feeding segment, the third radiation part and the fourth radiation part are disposed on the second surface, and electronically connected to the second feeding segment;

a first accessory portion disposed on the first surface, and electronically connected to the first radiation part for enhancing coupling effect therebetween;

a second accessory portion disposed on the first surface, and electronically connected to the second radiation part for enhancing coupling effect therebetween; and a ground plane for grounding;

a second antenna; and a third antenna, wherein the second antenna and the third antenna are parallel to and disposed on opposite two sides of the first antenna.

8. The antenna assembly of claim 7, wherein the second antenna and the third antenna have a same structure as the first antenna.

9. The antenna assembly of claim 8, wherein the first radiation part and the second radiation part both are symmetrically disposed at opposite sides of the first feeding segment with a switchback portion.

10. The antenna assembly of claim 9, wherein the third radiation part and the fourth radiation part both are symmetrically disposed at the opposite sides of the second feeding segment with a switchback portion.

11. The antenna assembly of claim 10, wherein the first radiation part comprises:

a first radiation segment;

a second radiation segment electronically connected to the first radiation segment;

a third radiation segment parallel to the first radiation segment, and electronically connected to the second radiation segment; and a fourth radiation segment parallel to the second radiation segment, and electronically connected to the third radiation segment.

12. The antenna assembly of claim 7, wherein the first radiation part, the second radiation part, the third radiation part, and the fourth radiation part have a same structure.

13. The antenna assembly of claim 7, wherein a distance between the first antenna and the second antenna and a distance between the first antenna and the third antenna are approximately equal to a half working frequency wavelength.

14. An antenna assembly, disposed on a circuit board comprising a first surface and a second surface opposite to the first surface, the antenna assembly comprising a plurality of antennas, and each antenna comprising:

a feeding part for feeding electromagnetic signals, comprising a first feeding segment disposed on the first surface and a second feeding segment disposed on the second surface;

a body portion for radiating and receiving electromagnetic signals, comprising a first radiation part, a second radiation part, a third radiation part, and a fourth radiation part, wherein the first radiation part and the second radiation part are disposed on the first surface, and electronically connected to the first feeding segment, the third radiation part and the fourth radiation part are disposed on the second surface, and electronically connected to the second feeding segment;

a first accessory portion disposed on the first surface, and electronically connected to the first radiation part for enhancing coupling effect therebetween;

a second accessory portion disposed on the first surface, and electronically connected to the second radiation part for enhancing coupling effect therebetween; and a ground plane for grounding.

15. The antenna assembly of claim 14, wherein there are same distances between each two adjacent antennas, and the antennas have a same structure.

16. The antenna assembly of claim 14, wherein the first radiation part comprises:

a first radiation segment;

a second radiation segment electronically connected to the first radiation segment;

a third radiation segment parallel to the first radiation segment, and electronically connected to the second radiation segment; and a fourth radiation segment parallel to the second radiation segment, and electronically connected to the third radiation segment.

17. The antenna assembly of claim 14, wherein the first radiation part, the second radiation part, the third radiation part, and the fourth radiation part have a same structure.

* * * * *